US005452896A

United States Patent [19]

Core

[11] Patent Number: 5,452,896

[45] Date of Patent: Sep. 26, 1995

[54] SPORTS PRACTICE CAGE

[75] Inventor: Rayford L. Core, Lake Charles, La.

[73] Assignee: Beginners Pro Swing, Throw, and Kick, Inc., Lake Charles, La.

[21] Appl. No.: 357,411

[22] Filed: Dec. 15, 1994

[51] Int. Cl.[6] ..... A63B 67/02; A63B 69/40

[52] U.S. Cl. ..... 273/181 F; 273/26 A; 273/410

[58] Field of Search ..... 273/181 F, 26 R, 273/26 A, 29 A, 127 R, 127 A, 127 B, 127 C, 410, 195 R, 181 R, 181 A

[56] References Cited

U.S. PATENT DOCUMENTS

| | | | |
|---|---|---|---|
| D. 276,466 | 11/1984 | Giovagnoli | D25/1 |
| 2,823,034 | 2/1958 | Bingham, Jr. | 273/181 F |
| 2,922,653 | 1/1960 | O'Brien | 273/410 |
| 3,222,067 | 12/1965 | Litwhiler et al. | 273/26 R |
| 3,408,071 | 10/1968 | Lundy | 273/26 R |
| 3,475,025 | 10/1969 | Uphaus | 273/26 A |
| 3,523,689 | 8/1970 | Cornell et al. | 273/195 R |
| 3,593,997 | 7/1971 | Bochner | 273/26 R |
| 3,980,304 | 9/1976 | O'Neill et al. | 273/26 R |
| 4,072,295 | 2/1978 | Roberts | 256/26 R |
| 4,556,219 | 12/1985 | Tillery | 273/181 F |
| 4,703,931 | 11/1987 | Steen | 273/410 |
| 4,815,736 | 3/1989 | Wright | 273/26 R |
| 4,858,922 | 8/1989 | Santavaci | 273/26 R |
| 4,890,834 | 1/1990 | Ponza | 273/26 R |
| 5,106,085 | 4/1992 | Lewy | 273/26 R |
| 5,370,385 | 12/1994 | Joy | 273/26 A |

*Primary Examiner*—Vincent Millin
*Assistant Examiner*—Steven B. Wong
*Attorney, Agent, or Firm*—Russel O. Primeaux; William David Kiesel; Robert C. Tucker

[57] ABSTRACT

A sports practice cage is disclosed. U-shaped side frames attach to a solid flat cage base, and horizontal poles connect the side frames to form the basic cage frame. Netting is suspended from the cage frame, with one side of the cage left open, so that a five-sided chamber is formed. A platform is connected to the cage base at the open end of the chamber, and a tee may be mounted on the platform. In an alternate embodiment the platform is a golf platform, and a golf tee pad is attached to the golf platform.

6 Claims, 2 Drawing Sheets

SPORTS PRACTICE CAGE

BACKGROUND OF THE INVENTION

1. Field of the Invention

This invention relates, generally, to sports practice cages, and, more particularly, to batting cages and golf practice cages.

2. Prior Art

In many sports in which a ball is thrown or struck, the player must normally have a large amount of space in which to practice. For example, in golf, a player who wants to practice his or her swing may go to a driving range. In another example, a young boy who wants to practice his baseball swing may set up a batting tee in a large yard and hit off the tee out into the yard. In each case, the player has to be outdoors and a large open space is required.

Occasionally the player may not have access to large outdoor areas such as playgrounds, fields, courses, or large residential yards. Even if the player has access to an adequate outdoor space, the player may not want the inconvenience of retrieving the ball from a long distance away from the player once the ball has been thrown or struck. In either case, players have resorted to the use of cages or backstops to contain the ball.

Various attempts have been made to provide portable backstops or cages. These devices are usually bulky, require extensive assembly, or are limited in utility to only one sport. What is needed is a device which will allow the player to practice a number of sports and which can be conveniently set up and taken down.

OBJECTS OF THE INVENTION

It is an object of the present invention to provide a sports practice cage which will stop the trajectory of several different sports balls such as baseballs, golf balls, soccer balls, and footballs.

Another object of the present invention is to provide a sports practice cage which is portable.

Another object of the present invention is to provide a sports practice cage which can be adapted for baseball batting practice, golf putting and full golf swing practice, and the practice of other sports.

Another object of the present invention is to provide a sports practice cage which can be easily assembled and disassembled.

Another object of the present invention is to provide a sports practice cage which can be used indoors.

Another object of the present invention is to provide a sports practice cage which is relatively inexpensive.

SUMMARY OF THE INVENTION

A multi-sports practice cage is provided. The cage has a base, side frames which fit into the base, and top and front poles which attach to the side frames so that a five sided chamber, with a front opening, is formed. A practice platform can be attached to the base. The practice platform may hold thereon various tees on which balls for various sports may be placed. Netting is draped from the cage for stopping the trajectory of a ball. In a preferred embodiment one or more extension frames, with netting, may be attached to the side frames and the practice platform.

A feature of the invention is that it can be stored in a space of relatively small volume.

A further feature of the invention is that it may be used by different age persons with equal utility. For example, a young boy may use the invention for baseball batting practice, and his father may use the invention for golf practice.

These and other objects, advantages, and features of this invention will be apparent from the following descriptions of the invention.

DETAILED DESCRIPTION

Figure 1:
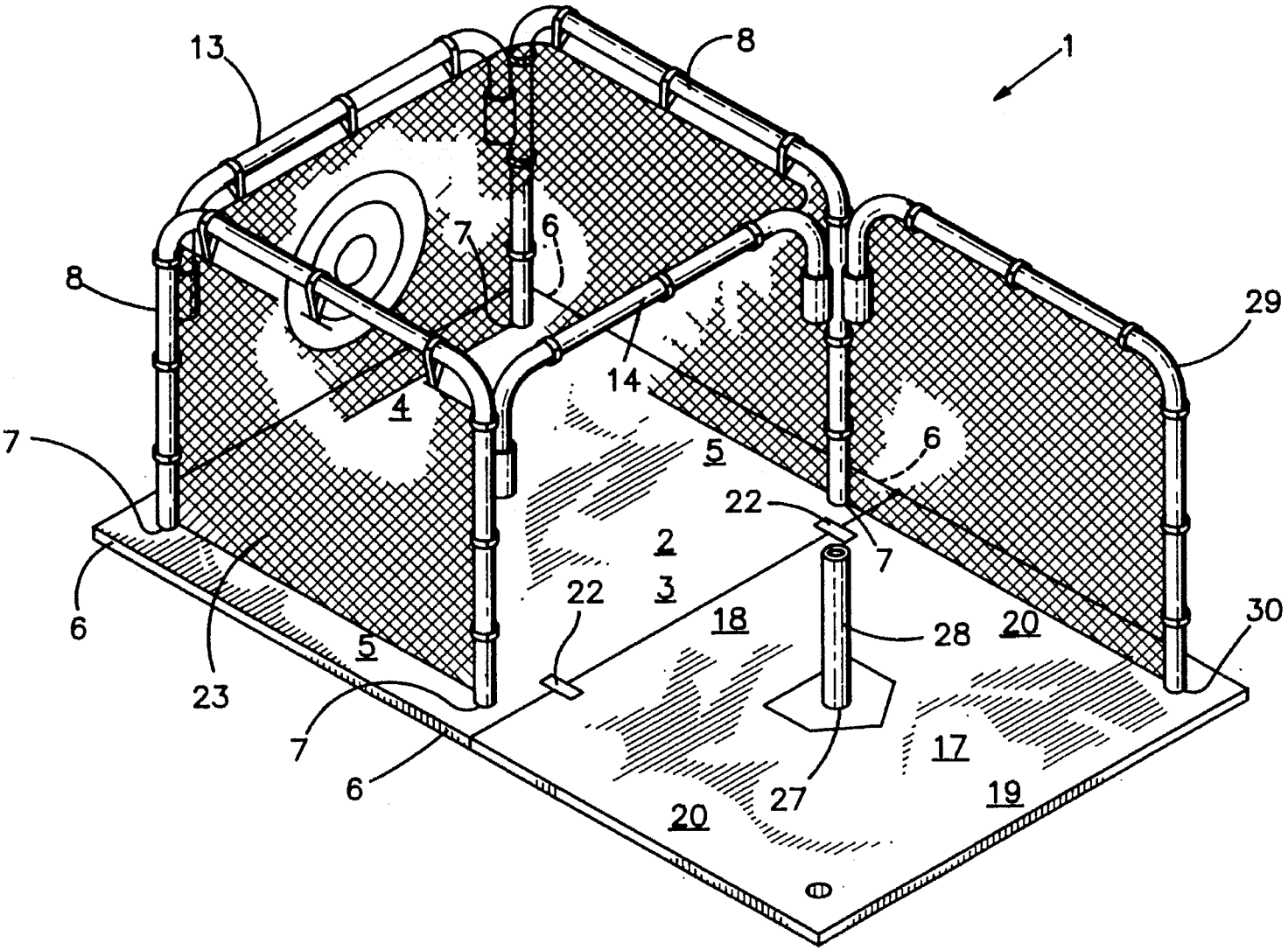
FIG. 1 is a perspective view of the invention. The embodiment depicted has the general platform.

Referring to FIG. 1, sports practice cage 1 is shown. Cage 1 has a horizontal flat cage base 2. In the embodiment depicted, cage base 2 is constructed of durable, dense plastic or rubber material. However, one could construct cage base 2 of any material suitable for constructing a semi-rigid base. Cage base 2 is a substantially rectangular member having front end 3, back end 4, and two cage base side ends 5. Cage base also has four corners 6.

In each corner 6 is side frame mounting means 7. Side frame mounting means 7 are adapted to mate with side frames 8. Although in the embodiment depicted, side frame mounting means 7 is an aperture sized to receive side frame 8, one could use a cylindrical extrusion which is adapted to slide into the vertical members of side frame 8, or any other conventional means or methods suitable for securing side frame 8 to cage base 2.

For a description of the various components of the frame for cage 1, reference will be made to FIG. 2, which depicts the invention with the golf platform 21. Side frames 8 are substantially vertical and are unitary, U-shaped, substantially rigid members. Each side frame 8 has side frame front pole 9, side frame back pole 10, and side frame top pole 11. Side frame front poles 9 and back poles 10 are adapted so that they may be connected and detached from side frame mounting means 7.

Side frame front poles 9 and back poles 10 will also include pole connectors 12. In the embodiment depicted pole connectors 12 are PVC cylindrical members sized to receive therein the ends of back pole 13 and front pole 14.

Back pole 13 and front pole 14 complete the main structure for cage 1 by connecting between side frames 7. Back pole 13 and front pole 14 each have opposing connector ends 15. Connector ends 15 are adapted to mate with and fit inside of pole connectors 12. Although in the embodiment depicted connector ends 15 are designed to fit in pole connectors 12, connector ends 15 and pole connectors 12 could be of any design or construction so long as connector ends 15 and pole connectors 12 may be detachably connected so as to form a frame for holding the netting.

In the embodiment depicted, side frames 8, back pole 13, and front pole 14 are constructed of PVC pipe. Pole connectors 12 are also constructed of PVC pipe and are of a larger diameter than the cage frame members. However, one skilled in the art could construct side frames using plastic, aluminum piping or tubing of any cross-section so long as the materials used were capable of forming a rigid frame from which netting 23 may be suspended.

Referring again to FIG. 1, general platform 17 is detachably connected to front end 3 of cage base 2. In the embodiment depicted, general platform 17 is constructed of the same material as that used in cage base 2. However, one skilled in the art could use other materials to construct general platform 17, as discussed above for cage base 2. When cage 1 is fully assembled, general platform 17 will be horizontal and parallel to cage base 2. General platform 17 is a substantially flat and substantially rectangular semi-rigid member. General platform 17 has pivot end 18, free end 19, and general platform side ends 20.

General platform 17 will include tee mounting means 27. Tee mounting means 27 will be used to attach various tees to general platform 17 so that the user may place a ball on a tee and strike the ball into the cage. In the embodiment shown tee mounting means 27 is an aperture. Baseball tee 28 is a semi-rigid tubular member constructed of rubber or plastic on general platform. Baseball tee 28 fits inside mounting means 27. One skilled in the art could reverse the relationship between baseball tee 28 and mounting means 27 so that mounting means 27 was a stub which fit inside baseball tee 28. One could also mount other tees, such as a football tee, on general platform 2 using mounting means 27.

Figure 2:
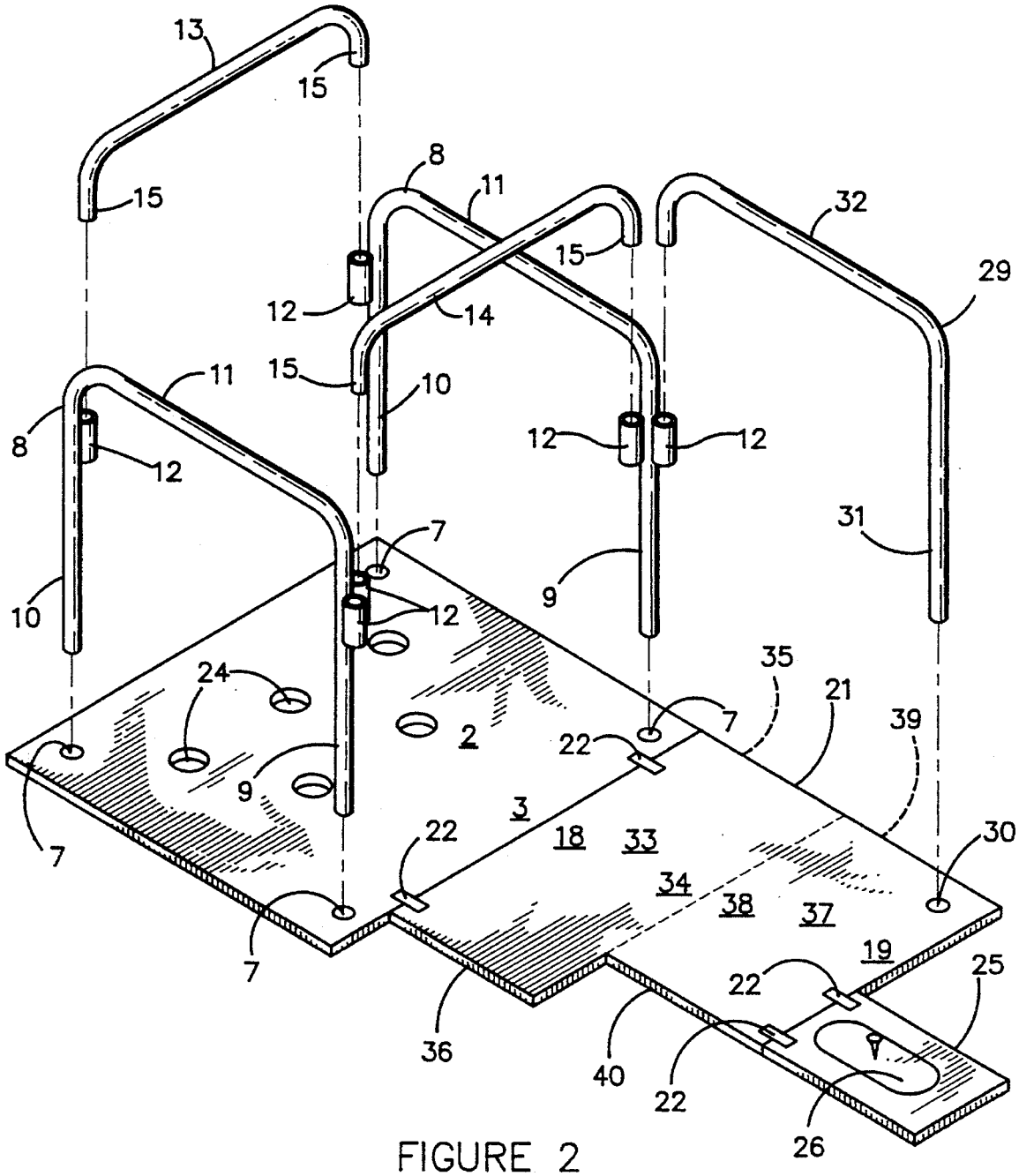
FIG. 2 is a perspective view of the invention. The embodiment depicted has the golf platform.

As shown in FIG. 2, both general platform 17 and golf platform 21 will be attached to cage base 2 using straps 22 which pass through apertures (not shown) in pivot end 18 of either general platform 17 or golf platform 21, and through apertures (not shown) in cage base front end 3. In the embodiment depicted straps 22 will be constructed of flexible fabric and VELCRO® so that straps 22 may be selectively attached and detached. If constructed with sufficient length and adjustability, straps 22 can serve an additional purpose of holding all of the frame members together when cage 1 is disassembled and folded up. One skilled in the art could use leather straps with buckles, a detachable hinge assembly, or any method or means of pivotably and detachably connecting cage base 2 to either general platform 17 or golf platform 21.

Referring again to FIG. 1, netting 23 is shown. Netting 23 is suspended from cage 1 and is detachably connected to side frames 8, back pole 13 and front pole 14. Netting 23 may be attached to the various cage members using tie straps or VELCRO® loops. Netting 23 hangs inside cage 1 so that the energy of a ball struck or thrown into cage 1 will be absorbed in netting 23 and not by the members which make up cage 1. After netting 23 is in place, a five-sided chamber with a front opening will be formed.

FIG. 2 shows an alternate embodiment of cage base which includes one or more golf cups 24. In the embodiment shown golf cups 24 are apertures in cage base 2 which may be used for putting practice. To create a more realistic surface, the user of the apparatus can place an artificial turf mat rolled over portions of golf platform 21 and cage base 2. Alternatively, one could cover the entire upper surface of golf platform 21 and cage base 2 with artificial turf.

Golf platform 21 will now be described in detail with reference to FIG. 2. Golf platform 21 is a flat substantially horizontal member, and like general platform 17, may be constructed of plastic or rubber. Golf platform 21 has substantially rectangular first section 33 which has pivot end 18, first section common end 34, first section common side end 35, and first section user side end 36. As described earlier, pivot end 18 will contain apertures (not shown) for straps 22 so that golf platform 21 may be pivotably and detachably connected to cage base front end 3.

Adjacent to first section 33 of golf platform 21 is substantially rectangular second section 37. Second section 37 has second section common end 38, free end 19, second section common side end 39, and second section user side end 40. Second section common end 38 is rigidly attached to first section common end 34 so that first section common side end 35 is co-linear with second section common side end 39. In this way a step-shaped golf platform 21 is formed.

In FIG. 2 golf platform 21 is shown in a configuration for right-handed golfers. However, the dimensions of first section 33 and second section 37 of golf platform 21 are chosen so that golf platform 21 may be flipped over for use by left-handed golfers.

Golf tee platform 25 is pivotably and detachably connected to free end 19 of golf platform by straps 22 passing through apertures (not shown) in golf tee platform 25 and free end 19 of golf platform 21. Golf tee platform 25 will have golf tee surface 26 which is capable of holding a conventional golf tee. Golf tee surface 26 may be clay or putty material, may be a series of flexible and resilient closely spaced tines or may be of any construction capable of placing a tee thereon.

One skilled in the art may also practice the invention by placing golf tee surface 26 directly onto second section 37. This may be done by constructing golf platform 21 of sufficient length along a line perpendicular to front pole 14 so that a golfer may practice his or swing without hitting front pole 14.

In a particularly preferred embodiment cage 1 will include extension frame 29. Extension frame 29 is a unitary L-shaped semi-rigid member constructed of the same materials used for side frames 8. Extension frame 29 has front pole 31 and top pole 32. Extension frame front pole 31 is detachably connected to extension frame mounting means 30, one of which are at each general platform side end 20. Extension frame top pole 32 is detachably and pivotably connected to pole connector 12 on one of side frame front poles 14. Netting 23 will also be suspended from extension frame 29.

There are of course other alternate embodiments which are obvious from the foregoing descriptions of the invention, which are intended to be included within the scope of the invention, as defined by the following claims.

I claim:

1. A sports practice cage comprising:

(1) a horizontal flat cage base having a front end, a back end, two side ends, and four corners, each said corner having a side frame mounting means;

(2) two vertical side frames, each said side frame being a unitary U-shaped member having a side frame front pole, a side frame back pole, and a side frame top pole, said side frame front and back poles being detachably and rigidly connected to said side frame mounting means, said side frame front and back poles further comprising pole connectors;

(3) a horizontal back pole having two ends, said back pole ends being detachably and pivotably connected to said pole connectors of said side frame back poles;

(4) a horizontal front pole having two ends, said front pole ends being detachably and pivotably connected to said pole connectors of said side frame front poles;

(5) a flat substantially horizontal general platform having a pivot end, a free end, and two side ends, said general platform pivot end being pivotably and detachably connected to said cage base front end; and (6) netting suspended from and detachably connected to said side frames and said front and back poles such that said netting together with said cage base forms a five-sided chamber.

2. The apparatus of claim 1, further comprising:

(1) a tee mounting means, on said general platform, for fixably and detachably mounting a tee for holding a ball; and (2) a tee, rigidly and detachably connected to said tee mounting means, said tee and said tee mounting means being adapted such that a user of the apparatus may stand on said general platform and strike a ball placed on said tee into said cage.

3. The apparatus in claim 2, further comprising:

(1) an extension frame mounting means at each general platform side end; and (2) at least one vertical extension frame, said extension frame being a unitary L-shaped member having a front pole and a top pole, said extension frame front pole being detachably and rigidly connected to one of said extension frame mounting means, said top pole being detachably and pivotably connected to said pole connector of one of said side frame front poles.

4. A sports practice cage comprising:

(1) a horizontal flat cage base having a front end, a back end, two side ends, and four corners, each said corner having a side frame mounting means;

(2) two vertical side frames, each said side frame being a unitary U-shaped member having a side frame front pole, a side frame back pole, and a side frame top pole, said side frame front and back poles being detachably and rigidly connected to said side frame mounting means, said side frame front and back poles further comprising pole connectors;

(3) a horizontal back pole having two ends, said back pole ends being detachably and pivotably connected to said pole connectors of said side frame back poles;

(4) a horizontal front pole having two ends, said front pole ends being detachably and pivotably connected to said pole connectors of said side frame front poles;

(5) a flat substantially horizontal golf platform comprising:

(i) a substantially rectangular first section having a pivot end, a common end, a common side end, and a user side end, said pivot end being pivotably and detachably connected to said cage base front end, (ii) a substantially rectangular second section having a common end, a free end, a common side end, and a user side end, said second section common end being rigidly attached to said first section at said first section common end, said common side end of said second section being co-linear with said common side end of said first section, said second section having a length along its common end less than the length of said first section along its common end; and (iii) the dimensions of said first section and said second section being adapted such that said golf platform may be flipped over and used by both right-handed and left-handed golfers;

(6) netting suspended from and detachably connected to said side frames and said front and back poles such that said netting together with said cage base forms a five-sided chamber.

5. The apparatus in claim 4, further comprising:

(1) an extension frame mounting means at said second section common side end; and (2) at least one vertical extension frame, said extension frame being a unitary L-shaped member having a front pole and a top pole, said extension frame front pole being detachably and rigidly connected to said extension frame mounting means, said top pole being detachably and pivotably connected to said pole connector of one of said side frame front poles.

6. The apparatus of claim 5, further comprising: a golf tee pad, pivotably and detachably connected to said free end of said second section of said golf platform, said golf tee pad having a golf tee surface for placing a golf tee therein.

* * * * *